United States Patent [19]

Mikhel

[11] 4,455,695

[45] Jun. 26, 1984

[54] GUIDING UNIT FOR SWIMMING POOL CLEANERS

[76] Inventor: John L. Mikhel, 6429 W. 144th Ct., Crown Point, Ind. 46307

[21] Appl. No.: 74,165

[22] Filed: Sep. 10, 1979

[51] Int. Cl.[3] ..... E04H 3/16

[52] U.S. Cl. ..... 4/490; 210/169

[58] Field of Search ..... 4/488, 490; 15/1.7; 210/169, 170, 242 R, 242 S

[56] References Cited

U.S. PATENT DOCUMENTS 982,621 1/1911 Maxey et al. ..... 405/28
4,068,327 1/1978 Heinlein ..... 210/169 X
4,089,074 5/1978 Sermons ..... 4/488 X
4,221,662 9/1980 Joseph ..... 210/169
4,225,436 9/1980 Cseh ..... 210/169

*Primary Examiner*—Harry N. Haroian
*Attorney, Agent, or Firm*—Sol J. Lehrer; Eugene F. Friedman

[57] ABSTRACT

A guiding unit for the surface water in a swimming pool, where the water flows toward an outlet in the pool wall. The water is guided toward the outlet by a floating guide bar; and the latter is held against lateral deviation by tie bars whose end portions are removably connected to the guide bar and the pool wall, respectively.

2 Claims, 5 Drawing Figures

GUIDING UNIT FOR SWIMMING POOL CLEANERS

My invention relates to swimming pools installed in the open areas of suburban and country homes, and more particularly to means for keeping such pools clean. During the open season litter—such as dead leaves, twigs and scum—form a layer on the surface of the water. If allowed to remain, such litter becomes saturated with water and sinks to the bottom of the pool, where it becomes settled and hard to remove. Apparatus has been devised to remove the litter while it is still afloat, such apparatus employing a cleaning unit imparting a marginal flow to the water in the pool. An opening in the side of the latter allows the litter-laden top layer, after it is intercepted by a guiding unit, to emerge from the pool into the cleaning unit; and the latter is composed of a skimmer, a pump and a filter, from which it is returned to the pool to assume the marginal flow mentioned. The apparatus referred to has—according to my observation—its guiding unit located permanently in a part of the pool, and is quite complicated.

One object of the present invention is to provide a guiding unit which occupies a part of the pool only during the cleaning operation, and is quickly removable after the same, leaving the entire pool clear for bathing or swimming.

A further object is to design the guiding unit with a guide bar in the form of a float which is light and self-supporting on the surface of the pool.

Another object is to provide a pair of simple tie bars removably connected to the rim of the pool and the guide bar in order to keep the latter in a stationary position during the cleaning operation.

A final object is to design the invention as a kit made up of few parts which may be compactly stored, assembled or taken apart by any person using the swimming pool, and without the need of tools.

A better understanding of the invention may be gained by reference to the accompanying drawing, in which.

Figure 5:
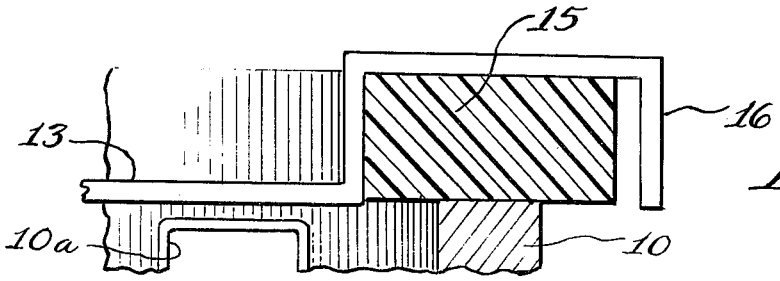
FIG. 5 is a magnified section on the line 5—5 of FIG. 1.

Referring to the drawing, the mentioned water outlet of the pool is an opening 10*a* in the wall 10 thereof, the upper half of the opening being indicated in FIG. 5. The element creating the marginal flow of water entering the pool is a pipe 11; and such flow is indicated by the arcuate arrows in FIG. 1.

Figure 2:
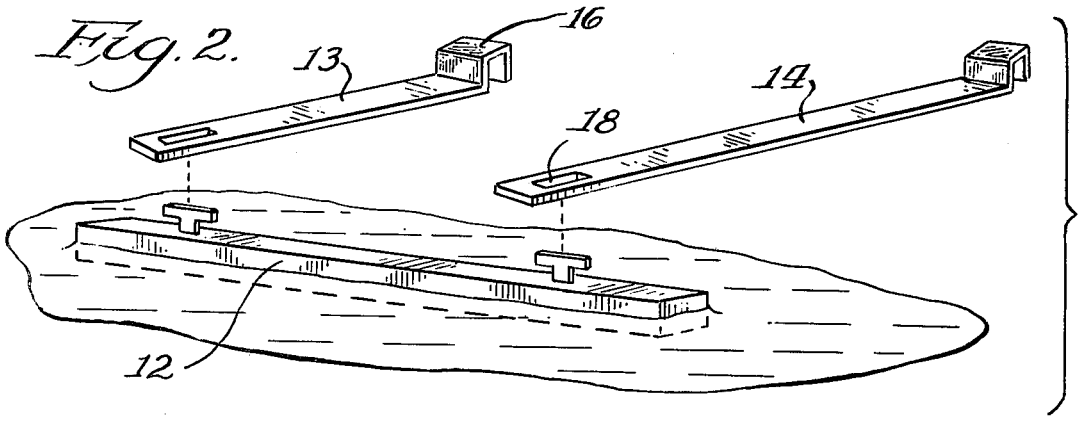
FIG. 2 is a group perspective view of the guiding unit components.
Figure 3:
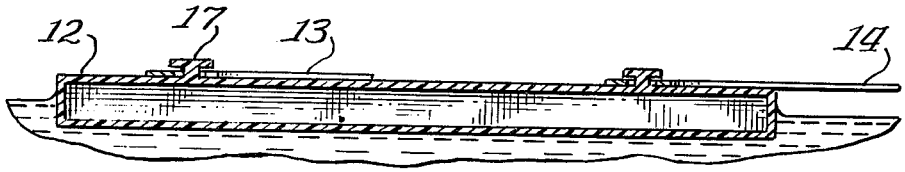
FIG. 3 is an enlarged section of the improved guide bar, taken on the line 3—3 of FIG. 1.

The improved guiding unit employs the conventional guide bar 12 for deflecting the surface layer of the pool contents toward the outlet 10*a*. The guide bar 12, which is usually several feet long, is of rectangular cross-section as seen in the lower part of FIG. 2, and hollow as seen in FIG. 3. When made of light metal or plastic substance the guide bar will float on the surface of the pool. It is therefore self-supporting and light.

The guide bar is set at a suitable angle for intercepting and guiding the polluted water in the top layer of the pool toward the outlet 10*a*.

To maintain the bar as set it is connected to the wall of the pool by a pair of tie bars 13 and 14. These bars are of identical flat metal or plastic construction, but different in length to meet the difference in distance to the pool wall. The tie bars make a short connection to the latter by being set at right-angles to the guide bar.

Figure 4:
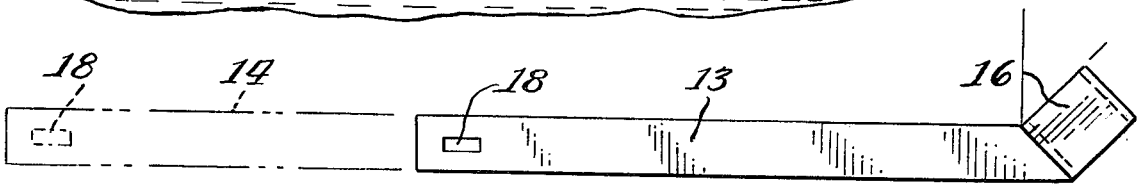
FIG. 4 is a plan view of a short tie bar, with a longer one indicated by dot-and-dash lines.

Pool walls are made with a wide rim 15; and the tie bars 13 and 14 are made with a hook 16 at their outer ends engaging the rim 15 as seen in FIG. 5. As seen in FIGS. 2 and 4, the hooks are turned laterally to an angle conforming to the curvature of the pool wall. This fixes the direction of the tie bars to the guide bar.

Figure 1:
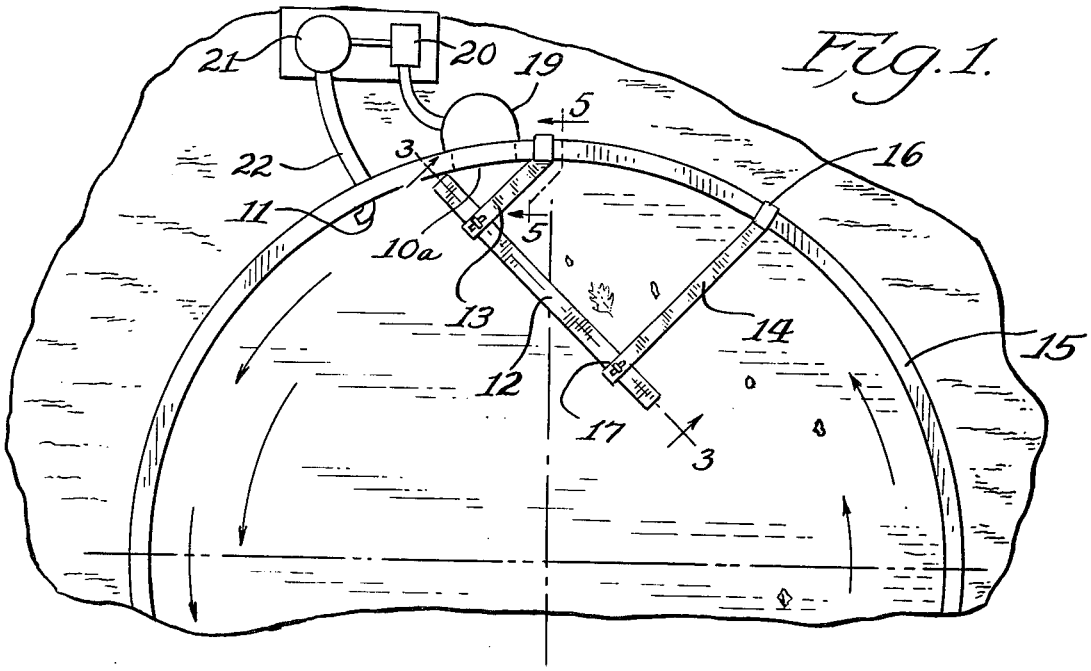
FIG. 1 is a plan view of a portion of the swimming pool, showing a cleaning installation employing the improved guiding unit.

The inner ends of the tie bars are attached to the guide bar by simple means. Thus, FIGS. 2 and 3 show that the guide bar rises with longitudinally-directed T-hooks 17 near the ends. The tie bars have similarly-directed slots 18 near the ends. When the guide bar is in place the tie bars are alined with it to receive the T-hooks through the slots 18. The tie bars are then swung crosswise of the guide bar as indicated in FIG. 1 to become locked at their inner ends to the T-hooks before engaging the hooks 17 with the wall of the pool as previously mentioned.

It is now apparent that the invention comprises but three simple parts—the guide bar and the two tie bars—which may be handled with ease and compactly stored while the pool is being used over its entire surface, and until the pool needs cleaning. Then installing the guiding unit, and turning on the pump should accomplish the cleaning of the pool in less than thirty minutes. The conventional cleaning apparatus accessory to the present guiding unit is indicated in the top part of FIG. 1 as a skimmer 19 for the polluted material, the pump 20, a filter 21, and a return duct 22 from the filter into the pipe 11. Such apparatus is available on the market, and no novelty is claimed for the same.

I claim:

1. The combination with a pool whose surface water flows along the pool wall toward an outlet; of a unit applicable to the pool and said wall, such unit formed with a floating guide bar directed at an angle to the wall, and a pair of tie bars connecting the end portions of the guide bar to the wall, the tie bars being of lengths corresponding to the angular spread of the guide bar where they connect with the same, said wall being curved and formed with a top rim, and the tie bars formed with hooks at the ends thereof and arranged at an angle to the longitudinal extent of the tie bars where they connect with said wall to engage said rim and thereby conform laterally with the curvature of the wall.

2. The combination with a pool whose surface water flows along the pool wall toward an outlet; of a unit applicable to the pool and said wall, such unit formed with a floating guide bar directed at an angle to the wall, and a pair of tie bars connecting the end portions of the guide bar to the wall, the tie bars being of lengths corresponding to the angular spread of the guide bar where they connect with the same, the tie bars having slots where they connect with the guide bar, and the latter having T-hooks passing through the slots when the tie bars are alined with the guide bar and locking the tie bars to the same when the tie bars are swung crosswise thereof.

* * * * *